United States Patent [19]

O'Connor

[11] 4,291,342

[45] Sep. 22, 1981

[54] TALKING MAILBOX STRUCTURE AND METHOD

[76] Inventor: Dermot O'Connor, 2311 N. Vermont Ave., Royal Oak, Mich. 48073

[21] Appl. No.: 48,349

[22] Filed: Jun. 14, 1979

[51] Int. Cl.[3] ..... G11B 5/00

[52] U.S. Cl. ..... 360/12; 360/137; 340/569

[58] Field of Search ..... 360/12, 137; 179/1 H, 179/16 EC, 100.1 C; 340/569, 692; 35/22 R

[56] References Cited

U.S. PATENT DOCUMENTS

| | | | |
|---|---|---|---|
| 4,100,581 | 7/1978 | Slack et al. | 360/12 |
| 4,117,461 | 9/1978 | Kiebala | 340/692 |
| 4,154,393 | 5/1979 | Darvishian | 179/1 H |

FOREIGN PATENT DOCUMENTS

| | | | |
|---|---|---|---|
| 442790 | 4/1927 | Fed. Rep. of Germany | 340/569 |

OTHER PUBLICATIONS

"Signal Wiring", by T. Croft, 1st Ed., 1926, McGraw Hill.

*Primary Examiner*—John H. Wolff

*Attorney, Agent, or Firm*—Whittemore, Hulbert & Belknap

[57] ABSTRACT

In combination, a mailbox, a portable cassette recorder-player positioned within the mailbox, and means for turning the cassette recorder-player on and off in response to opening and closing of the mailbox to play a changeable prerecorded message, and the corresponding method of providing a prerecorded message.

1 Claim, 3 Drawing Figures

TALKING MAILBOX STRUCTURE AND METHOD

BACKGROUND OF THE INVENTION

1. Field of the Invention

The invention relates to mailboxes and refers more specifically to a mailbox in combination with a cassette recorder-player and structure for turning the cassette recorder-player on and off on opening and closing of the mailbox whereby prerecorded messages may be delivered from the mailbox.

2. Description of the Prior Art

In the past, messages have been left for guests, children, service personnel such as mailmen, milkmen and the like by means of a note variously placed with the hope that the person for whom the note is intended will see it and read it. Such method of transmitting messages is undesirable in that the notes may be blown away, taken by vandals and/or read by those that the notes are not intended for.

SUMMARY OF THE INVENTION

Accordingly, the present invention provides a talking mailbox which will automatically deliver a prerecorded message on opening of the mailbox.

The invention includes a mailbox in combination with a cassette recorder-player and means for turning the casette recorder-player on and off on opening and closing of the mailbox to effect the method of the invention.

Means are provided for access to the cassette recorder-player from the front of the mailbox so that the message may be changed on the cassette recorder-player.

DESCRIPTION OF THE PREFERRED EMBODIMENT

Figure 1:
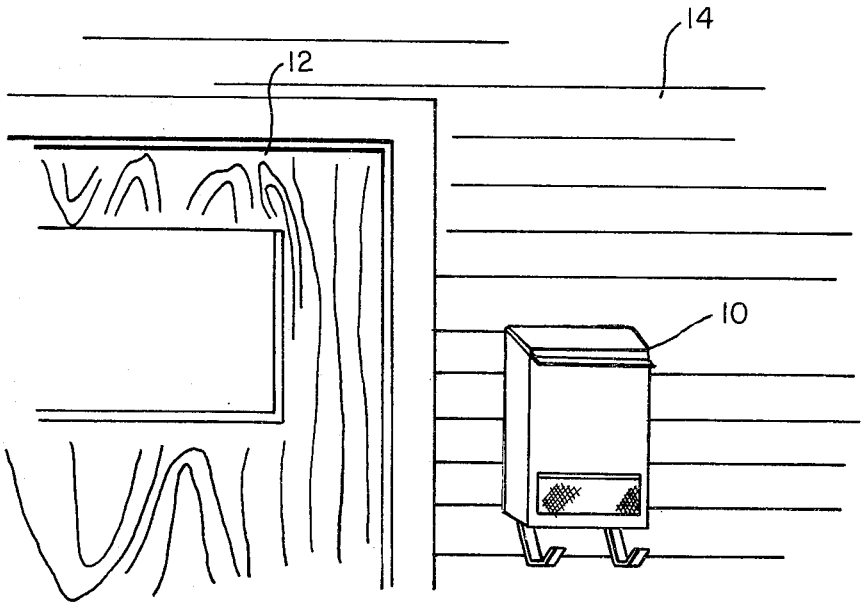
FIG. 1 is a partial elevation view of a home having a mailbox attached to it, constructed in accordance with the invention.
Figure 2:
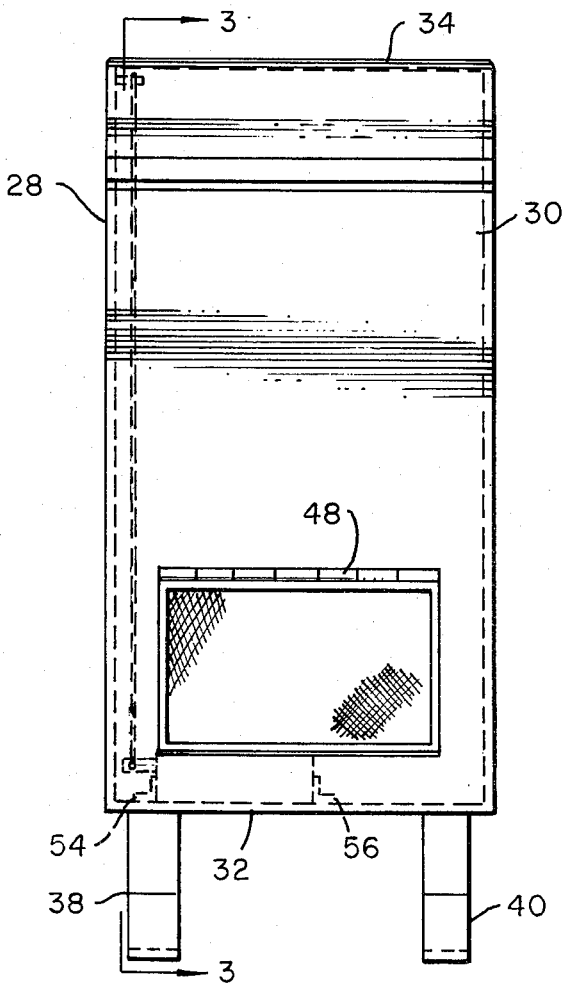
FIG. 2 is an enlarged front elevation view of the mailbox shown in FIG. 1.

As shown best in FIG. 1, a mailbox 10 constructed in accordance with the invention is positioned next to the front door 12 of a home generally indicated 14. The mailbox 10 is in combination with the cassette recorder-player 16 and means 18 for causing the cassette recorder-player 16 to turn on and off on opening and closing of the top of the mailbox 10, as illustrated best in FIGS. 2 and 3.

More specifically, the mailbox 10 in typical fashion contains a back 24, front 26, sides 28 and 30, bottom 32 and a top 34. Spring-like structures 38 and 40 are secured to the mailbox 10 to permit placing of large mail items, such as magazines and papers beneath the mailbox 10. Structures 38 and 40 may be connected to the mailbox 10 by convenient means, not shown.

The top 34 of the mailbox 10 is hinged at 42 and is provided with a lip 44 at the free edge 46 thereof whereby the top 34 may be lifted to place mail in the mailbox 10 and in accordance with the present invention to activate the cassette recorder-player 16.

The mailbox 10 is also provided with an opening 48 in the front thereof toward the bottom and a cover 50 for the opening. The cover 50 swings inwardly of the mailbox 10 and is of such dimension as to clear the cassette recorder-player 16 and provide access to the cassette recorder-player 16 so that cassettes may be changed therein. If the cassette recorder-player has the proper capabilities for changing the message on the cassette while it is in the mailbox, the opening 48 also provides access to the cassette recorder-player for this purpose. The cover 50 is transparent to sound whereby a recorded message from the cassette recorder-player 16 may be easily heard when the cassette recorder-player 16 is turned on.

The cassette recorder-player 16 may be any of a number of commercial cassette recorder-players which will receive a tape cassette on which a message has been transcribed and which will play the message on the cassette on being turned on. The cassette recorder-player is preferably self-contained. requiring no external power source and may have recording capabilities as well as playing capabilities whereby the messages on the cassette may be easily changed.

Figure 3:
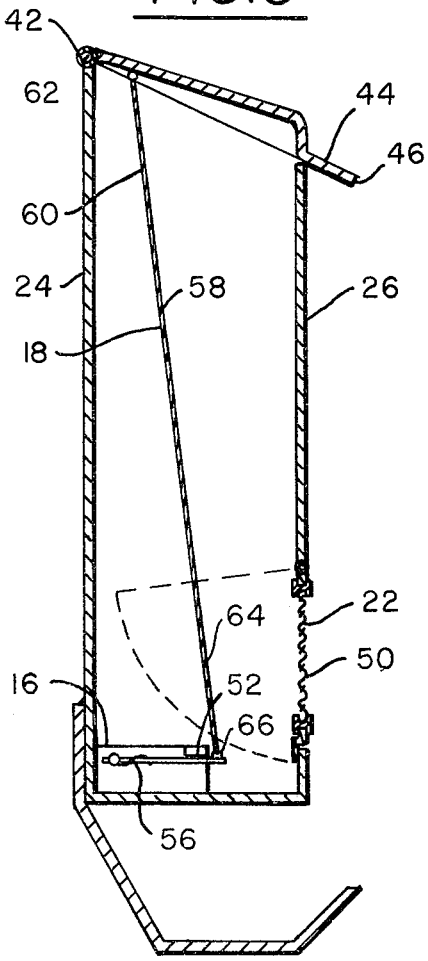
FIG. 3 is a longitudinal section view of the mailbox illustrated in FIGS. 1 and 2, taken substantially on the line 3—3 in FIG. 2.

The cassette recorder-player 16 is provided with a lever-type on/off switch 52 which is resiliently urged in a clockwise direction as shown in FIG. 3. Brackets 54 are provided to secure the cassette recorder-player to the bottom 32 of the mailbox 10.

The means 18 for causing the cassette recorder-player 16 to turn on and off on opening and closing of the top of the mailbox 10 includes the lever-type on-off switch 52 and the spring 56 urging the lever 52 into an off position as shown in FIG. 3. The means 18 further includes a thin wire 58 or the like connected at one end 60 to the top 34 of the mailbox 10 and at the other end 64 to the lever 52 at its free end 66.

In performing the method of the invention with the talking mailbox 10, a message for the mailman, a family member, or other selected person, is recorded on a cassette and placed in the cassette recorder-player 16, or the cassette recorder-player 16 is utilized to record the message providing the cassette recorder-player 16 has this capability. The cassette with the recorded message thereon is placed in the cassette recorder-player 16 through the opening 48 in the front 26 of the mailbox 10 with the cover 50 swinging inwardly and upwardly as illustrated in phantom in FIG. 3.

In such operation, the cassette recorder-player 16 and cover 50 are of such dimension and in such position that the cover may swing upwardly to permit placing of a cassette in the cassette recorder-player 16 or the taking of a cassette out of the cassette recorder-player without interference from the cassette recorder-player or the lever 52. This operation is effected with the top 34 of the mailbox 10 in a closed position as shown in FIG. 3. With the top in such position, the lever 52 is urged by the spring 56 so that the cassette recorder-player 16 is turned off.

Subsequently, when the mailman or other person to whom it is desired to provide the message opens the top 34 of the mailbox 10, the wire 58 is caused to move upwardly and the lever 52 is caused to move counterclockwise as shown in FIG. 3 to turn the cassette recorder-player 16 on, whereby the message is delivered. On subsequent closing of the top 34, the lever 52 is returned to the off position as shown in FIG. 3 under the bias of the spring 56.

While one embodiment of the talking mailbox of the invention has been described in detail, it will be understood that other embodiments and modifications thereof are contemplated. Thus, for example, the wire 58 may be replaced by a flexible string or cord, or if the wire 58 is sufficiently stiff, the spring 56 may be deleted. It is the intention to include all such embodiments and modifications as are defined by the appended claims within the scope of the invention.

I claim:

1. A mailbox comprising a substantially rectangular enclosure having a top thereon hinged at one side thereof for opening and closing on pivotal movement about the one side thereof, a message player in the bottom of the enclosure for accepting messages and playing them including a lever type on-off switch pivotally mounted at one end thereof for rotation about the pivotal mounting thereof to turn the message player on and off and resilient means for biasing the on-off switch into an off-position, and means operably associated with the enclosure top and message player for initiating playing of a message by the message player on opening of the mailbox comprising a linear member connected at one end to the top of the enclosure at a distance from the hinged one side thereof and at the other end to the free end of the on-off lever whereby on opening of the mailbox by pivoting of the enclosure top about the one side thereof the on-off lever is pivoted to an on position through the linear member and on closing of the enclosure top the on-off lever is pivoted into an off position by the resilient biasing means, a door in the front of the enclosure adjacent the bottom hinged at the upper side thereof for swinging movement into the mailbox to permit access to the message player having a sound transparent central area, said message player being positioned on the bottom of the enclosure and being of a size to permit free swinging movement of the door into the mailbox, said on-off lever and linear member are positioned adjacent one side of the enclosure so as not to interfere with the swinging movement of the door whereby a message may be provided for a mailman or the like by pre-recording the message on the message player in the mailbox so that the message player is turned on in response to the mailman opening the top of the mailbox, and turned off in response to the mailman closing the top of the mailbox.

* * * * *